United States Patent [19]

Katsukawa

[11] Patent Number: 4,653,940

[45] Date of Patent: Mar. 31, 1987

[54] DOT-MATRIX PRINTER WITH DOT COUNTER FOR EFFICIENT HIGH-QUALITY PRINTING

[75] Inventor: Satoshi Katsukawa, Nagoya, Japan

[73] Assignee: Brother Kogyo Kabushiki Kaisha, Aichi, Japan

[21] Appl. No.: 779,095

[22] Filed: Sep. 23, 1985

[30] Foreign Application Priority Data

Sep. 25, 1984 [JP] Japan ..... 59-200258
Nov. 6, 1984 [JP] Japan ..... 59-234732

[51] Int. Cl.[4] ..... B41J 3/12
[52] U.S. Cl. ..... 400/121; 400/54; 400/124
[58] Field of Search ..... 400/669, 54, 121, 120; 346/76 PH; 101/93.04, 93.05

[56] References Cited

U.S. PATENT DOCUMENTS 4,415,907 11/1983 Suemori ..... 400/120 X
4,464,669 8/1984 Sekiya ..... 400/120 X
4,536,774 8/1985 Inui ..... 400/120 X
4,574,293 3/1986 Inui ..... 400/120 X

FOREIGN PATENT DOCUMENTS 069071 4/1983 Japan ..... 400/54
5916765 1/1984 Japan ..... 400/54
162063 9/1984 Japan ..... 400/54

OTHER PUBLICATIONS

*IBM Tech. Disc. Bulletin*, by B. R. Cavill, vol. 24, No. 11A, Apr. 1982, pp. 5430–5432.

*Primary Examiner*—Paul T. Sewell
*Attorney, Agent, or Firm*—Parkhurst & Oliff

[57] ABSTRACT

A dot-matrix printer with a print head having plural print elements which are disposed in a row and selectively activated to form a dot or dots in a vertical row of a dot matrix pattern representing a character, comprising: a device for calculating a dot ratio which is a ratio of the number of dots to be formed in a ratio-check area consisting of a predetermined number of vertical rows of dots in a print line, with respect to the maximum number of dots formable in the ratio-check area; a device for moving the ratio-check area along the print line; a device for checking if the dot ratio has exceeded a reference value; and a control device for printing the characters in the print line in plural movements of the print head if the print line includes the ratio-check area the dot ratio of which has exceeded the reference value. Also disclosed a dot-matrix printer, comprising a device for adding to a content of a memory numbers of dots which are formed by the print elements; a device for measing a time lapse; a device for subtracting a predetermined value from the content of the memory, at predetermined time intervals; a device for checking whether the content of the memory has exceeded a reference value; and a control device for controlling the print head so as to cool the print head if the content of the memory has exceeded the predetermined value.

10 Claims, 8 Drawing Figures

S64 : COMPARING THE CALCULATED DOT RATIO WITH REFERENCE DOT RATIO.

S66 : DOT RATIO OF THE LAST RATIO-CHECK AREA CALCULATED ?

DOT-MATRIX PRINTER WITH DOT COUNTER FOR EFFICIENT HIGH-QUALITY PRINTING

BACKGROUND OF THE INVENTION

1. Field of the Art

The present invention relates generally to a dot-matrix printer capable of printing characters such as letters, symbols and graphical representations, with a matrix of dots. More particularly, the invention is concerned with such a dot matrix printer which is free from printing troubles due to a drop in drive voltage of a print head, or an abnormal rise in temperature of the print head, when dots are formed continuously with a relatively high density.

2. Related Art Statement

In a common dot-matrix printer, print elements provided on a print head are disposed in a row and selectively activated to form dots in a vertical row of a dot matrix pattern corresponding to a character. It is ideal to determine a capacity of a power supply to the print head so that a drive voltage will not significantly drop even if all print elements are activated to form the corresponding all dots in successive rows continuously. Actually, an average power requirement for printing ordinary letters and symbols is only a half or less than a half of that for full-dot printing with concurrent activation of all print elements. For this reason, dot-matrix printers usually use a power supply of relatively small capacity that meets the actual average power consumption, for reduced cost of the power supply.

With such a relatively small capacity power supply, however, some of the graphical representations or figures available on the printer may not be correctly printed. More specifically, the printing of graphical representations more or less requires a comparatively large number of dots to be formed in a vertical row of a dot matrix pattern, that is, requires a higher dot ratio which is a ratio of the number of the print elements that are activated, with respect to the number of the print elements provided on the print head, than the printing of ordinary letters or symbols. Accordingly, the printing of some graphical representations requires a relatively larger energy input, which may lead to a shortage of power stored in a capacitor used as a power source for the printer. That is, the voltage level of the capacitor may drop and become insufficient to drive all of the intended print elements. Thus, some of the print elements may fail to be operated as required, if the printer is driven with a relatively small power supply. In such events, the corresponding dots will not be formed with a sufficient density, resulting an a poor print quality.

A control arrangement for a dot-matrix printer to solve the above-addressed problem is proposed in Japanese Patent Application which was laid open in 1984 under Publication No. 59-16765. The proposed control arrangement is adapted to obtain a "dot ratio" which is a ratio of the number of dots which are to be formed in each print line (each line of characters), with respect to the maximum number of dots which are formable in each print line. In the event that the obtained dot ratio of a given print line exceeds a predetermined reference value corresponding to a capacity of a power source for the print head of the printer, the characters in that print line are printed in plural movements of the print head along the print line. For example, some of the print elements that should be activated to form dots in each vertical row of a matrix pattern are activated while the print head is moved in one direction along the print line, and the remaining print elements that should be activated are activated while the print head is moved in the opposite direction. On the other hand, if the obtained dot ratio is less than the reference value, that print line is printed in one movement of the print head.

In the above proposed control arrangement, the obtained dot ratio of a print line is an average ratio of the dots which will be formed in the print line, with respect to the maximum dot number of the line. It will be understood that the average dot ratio of a print line may be lower than the predetermined reference value even if that print line contains a portion whose dot ratio is very high. For example, the average dot ratio of a print line as a whole may be comparatively low even if that line contains a succession of graphic representations which are formed by dots of a very high density per unit area. In this instance, the dot ratio of the graphic portion of the print line is far higher than the remaining portion which consists mainly of letters. However, the graphic portion is printed in one movement of the print head. Consequently, when the graphic portion is printed continuously, the drive voltage of the print head will drop, causing the print elements to fail to operate as required. Thus, the graphic portion may not be printed with a satisfactory print quality due to omission of some dots.

In the art of dot-matrix printing, it is also recognized that an abnormal temperature rise or overheat of a print head will result in poor printing quality. More specifically, in the case of a wire-dot printer, an insulating property of insulators for solenoids to activate the print wires will be reduced when the temperature of the print head is excessively elevated. Consequently, the solenoids tend to fail to be energized as required, whereby the corresponding dots may not be formed. In the case of a thermal-matrix printer, an excessive rise of the print head temperature will cause the thermal ribbon to be more or less fused by portions of the print head other than the heat-generating elements which are activated. In this case, a print sheet or other recording medium is soiled with an ink, or the characters may not be printed clearly.

To solve the above problem, it has been attempted to use a sensor to detect the temperature of the print head, and dissipate heat from the print head with a suitable method, when the detected temperature exceeds a predetermined upper limit. For example, the heat dissipation is accomplished by printing a line of characters in plural movements of the print head, or by interrupting a printing cycle part way through a print line or at the end of the line for a necessary length of time. Another solution to the same problem is proposed, wherein the heat dissipation is effected when the average dot ratio of a print line exceeds a predetermined reference value, as previously described.

The above proposed solutions suffer the following inconveniences. Namely, the use of a temperature sensor will complicate the printer and increase the cost. In the case of cooling the print head when the dot ratio has exceeded the reference value, the dot ratio does not necessarily accurately represents the temperature of the print head, because the heat is dissipated from the print head while the print sheet is fed or the printing cycle is interrupted. Accordingly, the heat dissipation may be insufficient, or the printer spend an unnecessarily long time for heat dissipation from the printer. In the former case, the problem of heat will not be completely eliminated. In the latter case, the printing efficiency is reduced.

SUMMARY OF THE INVENTION

It is therefore an object of the present invention to provide an improved dot-matrix printer, which is simple in construction and economical to manufacture, and which is capable of efficient printing without a decline in print quality even when the dot ratio or temperature of the print head is considerably varied within a single line of characters, or during a printing of a single line.

Another object of the invention is the provision of a dot-matrix printer which assures a satisfactory printing of graphical representations having a high dot ratio, even when these graphic representations are included in a line which contains letters, symbols and other characters having a low dot ratio.

A further object of the invention is to provide a dot-matrix printer having means for estimating a variation in temperature of its print head as accurately as possible, without using a temperature sensor, and for permitting a highly efficient printing without a decrease in print quality due to overheat of the print head.

According to the present invention, there is provided a dot-matrix printer including a print head having plural print elements which are selectively activated, during a movement of the print head, to form a dot or dots in a vertical row of a dot matrix pattern representing a character, comprising: means for setting up a ratio-check area consisting of a predetermined number of vertical rows of dots in a print line; memory means for storing the number of dots which are to be formed in said ratio-check area; calculating means for calculating a dot ratio which is a ratio of the number of dots which is stored in said memory means, with respect to a maximum number of dots which are formable in the ratio-check area; area-shifting means for moving the ratio-check area from a beginning of the print line to an end thereof; judging means for checking whether the dot ratio calculated by the calculating means has exceeded a predetermined reference value, while the ratio-check area is moved; and printing control means for printing the characters in the print line in plural movements of the print head along the print line, if the judging means has judged that the print line includes the ratio-check area the dot duty of which has exceeded the predetermined reference value.

In the dot-matrix printer of the invention constructed as described above, the ratio-check area which consists of a predetermined number of vertical rows of dots in each line of characters is shifted along the entire length of each print line in steps of a predetermined number of rows. In each ratio-check area of the print line, the dot ratio is calculated to check if the calculated dot ratio of that ratio-check area exceeds the predetermined reference value. If the print line has any ratio-check area with an excessive dot ratio, the characters in that line are printed by moving the print head along the print line plural times, i.e., in two or more movements of the print head along the print line. Thus, a portion of a print line having a high dot ratio over the reference value may be printed without unfavourable omission of dots. Therefore, successive graphic figures of a high dot density per unit area may be printed with a satisfactory print quality. This is contrary to the conventional arrangement wherein a portion of a line which consists of such successive graphic figures may be printed in one movement of the print head because the average dot ratio may be lower than the reference value. In the conventional arrangement, therefore, some of the dots may not be formed in the graphic figures. According to the invention, such unfavourable omission of dots that degrades the print quality will be completely avoided, because the dot ratio is obtained in each of plural portions of each print line by shifting the ratio-check area along the whole length of the print line.

According to another aspect of the invention, there is provided a dot-matrix printer including a print head having plural print elements which are selectively activated, during a movement of the print head, to form a dot or dots in a vertical row of a dot matrix pattern representing a character, comprising: a dot-number memory; adding means for adding to a current content of the dot-number memory, numbers of dots which are formed by the print elements during movements of the print head; time-measuring means for measuring a time lapse; subtracting means for subtracting a predetermined value from the current content of the dot-number memory, each time the time-measuring means has measured a predetermined time interval which is shorter than a time necessary to print a line of characters; juding means for checking whether the current content of the dot-number memory has exceeded a predetermined reference value; and printing control means for controlling the print head so as to cool the print head, if the judging means has judged that the current content of the dot-number memory has exceeded the predetermined reference value.

In the dot-matrix printer constructed as described above, the number of dots which are formed by the activated print elements is added to the current content of the dot-number memory in order to sum up the amount of heat generated by the print head. In the meantime, the predetermined number is subtracted from the current content of the dot-number memory in order to subtract from the accumulative amount of heat (which has been generated in the print head) the amount of heat which is dissipated in each lapse of the predetermined time interval. In other words, the predetermined number of value to be subtracted is equivalent to the sum of heat dissipated in the predetermined time interval. Accordingly, the current content of the dot-number memory represents the current amount of heat accumulated in the print head. For this reason, the temperature of the print head or the amount of heat accumulated in the print head may be estimated by judging whether the current content is greater than the reference value. This judgement may be done after a line of characters have been printed, and before the following line of characters have been printed. Alternatively, the judgement may be made once or plural times during printing of a line of characters, for example, at the end of printing of each row of dots. It will be obvious that where the judgement is made during printing of a print line, the judgement of the necessity of cooling the print head is accomplished based on a temperature variation of the print head while the print head is printing that print line. That is, the judgement is not based on the average value of temperature of the print head during a period in which the entire print line is printed. Similarly, where the judgement is made between the printings of adjacent two print lines, the judgement whether the cooling of the print head is necessary is accomplished based not on the average temperature value, but on the amount of heat accumulated in the print head (temperature of the print head) at the moment when the last print line has been printed. In either of the above two different cases, the judgement according to the invention requires no temperature sensors, and is more accurate than the conventional judgement based on the estimation of a temperature of the print head based on an average dot ratio of the entire length of a print line. Hence, the dot-matrix printer of the invention is improved in print quality and printing efficiency.

The print head may be cooled by printing a line of characters in plural movements of the print head along the print line, so that the amount of heat generated by the print head is smaller than the amount of heat dissipated. Alternatively, the cooling of the print head may be achieved by interrupting a printing cycle for a suitable length of time, and thereby allowing the print head to be air-cooled. It is also possible to interrupt a printing cycle and move the print head to positively air-cool the print head.

BRIEF DESCRIPTION OF THE DRAWING

The foregoing and other objects, features and advantages of the present invention will become more apparent from reading the following description of preferred embodiments of the invention, when considered in connection with the accompanying drawing, in which.

DETAILED DESCRIPTION OF THE PREFERRED EMBODIMENTS

To further clarify the concept of the present invention, preferred embodiments of the invention will be described in detail, by reference to the accompanying drawing.

Figure 1:
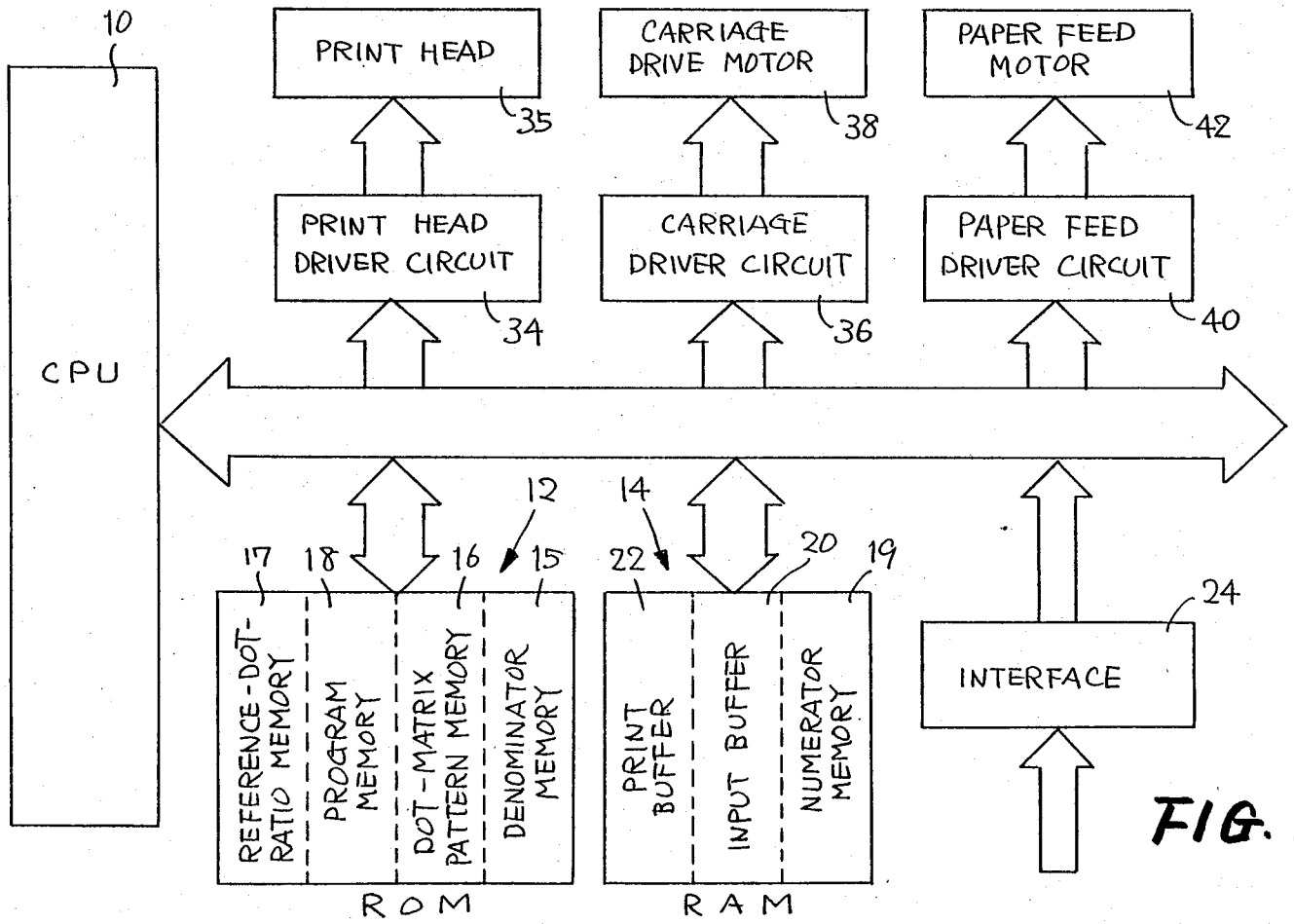
FIG. 1 is a schematic block diagram showing a control system of one embodiment of a dot-matrix printer of the invention.

Referring first to FIG. 1, there is shown a control system of an impact dot-matrix printer constructed according to one aspect of the present invention, wherein reference numeral 10 designates a central processing unit (hereinafter simply referred to as "CPU"). The CPU 10 is connected, via an interface 24 and a data bus, to an external device such as a host computer. The CPU 10 is further connected to a read-only memory 12 (hereinafter called "ROM") and to a random-access memory 14 (hereinafter called "RAM"). The ROM 12 includes a denominator memory 15, a dot-matrix pattern data memory 16, a reference-dot-ratio memory 17, and a program memory 18. The dot-matrix pattern memory 16 stores dot-matrix pattern data which represent dot-matrix patterns corresponding to the characters such as letters, digits, symobls and graphic representations. The program memory 18 stores various programs for controlling a printing operation of the printer, and for detecting a dot ratio which will be described in detail. The RAM 14 includes a numerator memory 19, an input buffer 20 and a print buffer 22. The input buffer 20 temporarily stores printing data corresponding to a line of characters which is transferred from the external device via the interface 24. The print buffer 22 temporarily stores dot-matrix pattern data which corresponds to the input printing data stored in the input buffer 20 and which has been retrieved from the dot-matrix pattern memory 16 based on the printing data in the input buffer 20.

Figure 2:
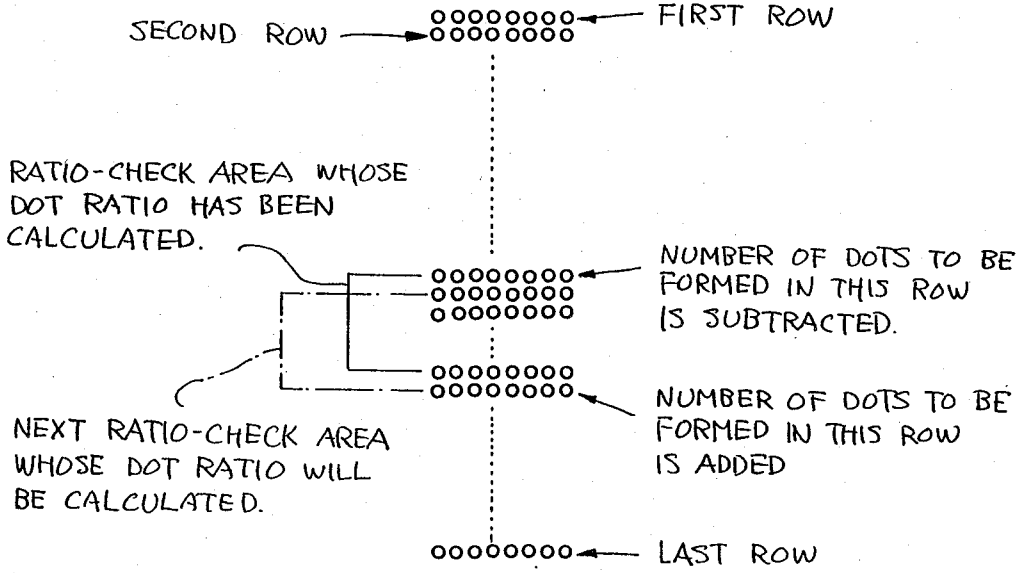
FIG. 2 is an illustration showing a manner of obtaining a dot ratio of a radio-check area of a print line.

The dot-matrix printer equipped with the control system of FIG. 1 is provided with a print head 35 having eight print elements in the form of stiff print wires which are disposed in a vertical row perpendicular to a line of printing. The print wires are provided to make a row of corresponding eight dots on a recording medium, as indicated in FIG. 2. As the row of print wires is moved horizontally along a print line, the print wires are selectively activated so that the resulting $8\times8$ dot-matrix pattern forms a desired character.

Upon transfer of the dot-matrix pattern data from the dot-matrix pattern memory 16 into the print buffer 22 according to the input printing data from the external device, the CPU 10 sets up a ratio-check area on the dot-matrix pattern data in the print buffer 22. The ratio-check area consists of a predetermined number of vertical rows of dots are counted from the first row of the line of characters which are represented by the dot-matrix pattern data stored in the print buffer 22. The numerator memory 19 of the RAM 14 stores the number of dots which are to be formed in the set-up ratio-check area of the print line, namely, the total number of dots to be formed by the print wires which are activated according to a portion of the dot-matrix pattern data which corresponds to the ratio-check area. The ratio-check area (number of vertical rows of dots) is predetermined by the nominal capacity of a power supply to drive the print head 35. Described in more detail, the drive voltage of the print head 35 is lowered gradually as the printing is effected continuously while the print head 35 is moved with all the print wires activated. At a certain row of dots, a failure of one or more print wires will take place due to excessive drop of the drive voltage. The number of vertical rows of dots which constitute the ratio-check area is determined to be the maximum number of rows which may be printed continuously without an excessive drop of the drive voltage, i.e., without a failure of any print wire. In this specific embodiment, the ratio-check area consists of 72 vertical rows of dots.

The CPU 10 calculates the previously indicated dot ratio which is a ratio of the number of dots which are to be actually formed in the ratio-check area (successive 72 rows), with respect to the maximum number of dots which can be formed in the ratio-check area. In other words, the dot ratio is a ratio of the number of dots stored in the numerator memory 19 of the RAM 14, to the number of dots stored in the denominator memory 15 of the ROM 12. The calculated dot ratio is compared with a reference dot ratio which is stored in the reference-dot-ratio memory 17 of the ROM 12, to check to see if the calculated dot ratio exceeds the reference dot ratio. In this embodiment, the reference dot ratio is determined to be 43%.

The CPU 10 then moves or shifts the ratio-check area by one row in the direction toward the last row (to the right in FIG. 2). Stated in greater detail, the number of dots which are to be formed in the row preceding the first ratio-check area is added to the content of the numerator memory 19, while the number of dots to be formed in the first row (the row at the trailing end of the first ratio-check area in the direction of shift) is subtracted from the content of the numerator memory 19. Thus, the second ratio-check area is set up. Subsequently, the dot ratio of this newly established ratio-check area is calculated and compared with the reference dot ratio. In the same way, the ratio-check area is moved toward the last row, and the dot ratios of the subsequent ratio-check areas are calculated. While the instant embodiment is adapted to shift the ratio-check area by one row at a time, it is possible that the ratio-check area is shifted in steps of two or more rows.

In the event that there exists any ratio-check area whose dot ratio exceeds the reference ratio stored in the reference-dot-ratio memory 17 of the ROM 12, the CPU 10 controls the printer so as to print the appropriate line of characters in plural movements of the print head 35. For example, the first printing is effected with only the even-numbered print wires (as counted from the uppermost or lowermost print wire) while the print head 35 is moved along the print line, and the second printing is effected with only the odd-numbered print wires (as counted from the uppermost or lowermost print wire) while the print head 35 is moved in the same direction as the first printing, or in the opposite direction. It will be obvious that the printing may be completed in more than two movements of the print head 35, if the dot ratio of any ratio-check area exceeds the reference dot ratio.

Referring back to FIG. 1, the CPU 10 is connected to a print head 35 driver circuit 34 to which is connected the print head 35. The print wires incorporated in the print head 35 are selectively activated by means of an electromagnetic device (not shown), according to the dot-matrix pattern data stored in the print buffer 22. The print head is connected to a power supply whose capacity is selected so that ordinary letters, digits and symbols may be printed as required. The CPU 10 is further connected to a carriage driver circuit 36 and to a paper feed driver circuit 40. According to a carriage drive signal, the carriage driver circuit 36 is operated to activate a carriage drive motor 38 to move a carriage carrying the print head 35, in opposite directions along the line of printing. The paper feed driver circuit 40 is operated according to a paper feed signal, to activate a paper feed drive motor 42 to feed the recroding medium perpendicularly to the line of printing.

Figure 3:
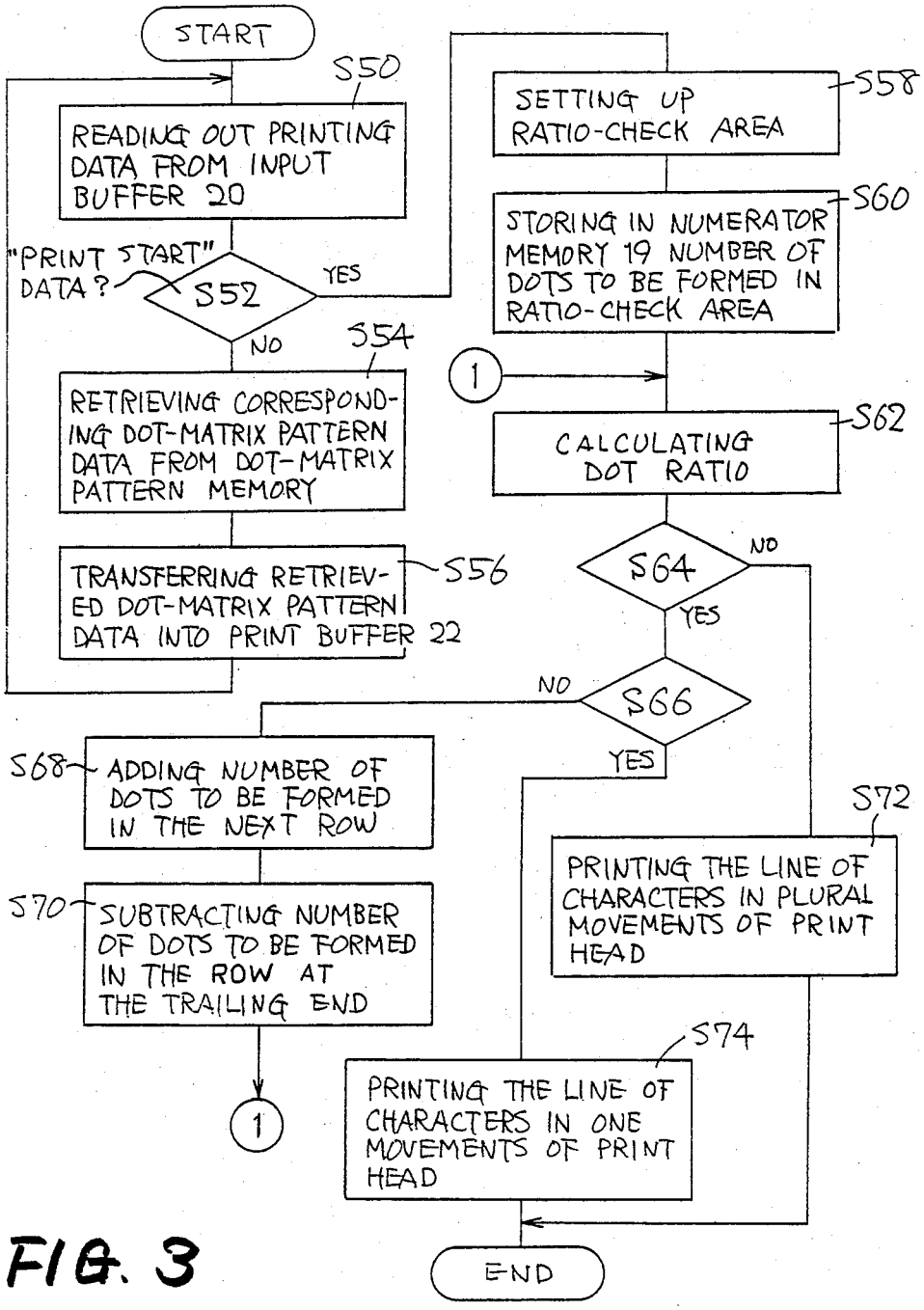
FIG. 3 is a flow chart illustrating the operation of the dot-matrix printer of FIG. 1.

Referring next to FIG. 3, the operation of the dot-matrix printer constructed as described hereto will be described in detail. For easy understanding, steps of operation are indicated by step numbers following letter S.

When printing data has been stored in the input buffer 20, the CPU 10 reads out the printing data from the input buffer 20 in step S50, and checks in step S52 to see if the printing data in the input buffer 20 is print start data which is provided at the end of a set of printing data representing each line of characters. If the printing data is not print start data, the CPU 10 goes to step S54 wherein the dot-matrix pattern data corresponding to the input printing data is retrieved from the dot-matrix pattern memory 16. Then, the CPU 10 executes step S56 to transfer the retrieved dot-matrix pattern data into the print buffer 22. With the above steps S50, S52, S54 and S56 executed repeatedly, the dot-matrix pattern data corresponding to the printing data for all the characters in one print line are stored in the print buffer 22.

When print start data has been stored into the input buffer 20 and the CPU 10 judges in step S52 that the input printing data is the print start data, step S52 is followed by step S58 in which the CPU 10 sets up, on the dot-matrix pattern data in the print buffer 22, a first ratio-check area consisting of 72 rows of dots are counted from the first row of the print line, as previously described. Then, in the following step S60, the number of dots to be formed in the set-up ratio-check area (first 72 vertical rows of the print line) is stored in the numerator memory 19 of the RAM 14. The CPU 10 then goes to step S62 to calculate a dot ratio of the first ratio-check area, based on the dot number stored in the numerator memory 19, and the maximum dot number stored in the denominator memory 15. In the next step S64, the calculated dot ratio is compared with the reference dot ratio stored in the reference-dot-ratio memory 17. If the calculated dot ratio is equal to or smaller than the reference dot ratio, step S64 is followed by step S66 in which the CPU 10 checks whether the dot ratio of the last ratio-check area (last 72 rows of the print line) has been calculated, that is, checks to see if the checking of the dot ratio of the entire dot-matrix pattern data in the print buffer 22 has been completed, or not. In this specific point of time, the dot ratio has been completed only on the first ratio-check area. Consequently, the result of checking in step S66 is negative, and the CPU 10 goes to step S68 wherein the number of dots to be formed in the row (73rd rowof the print line) preceding the first ratio-check area is added to the content of the numerator memory 19. Subsequently, the CPU 10 goes to step S70 in which the number of dots to be formed in the row (first row of the print line) at the trailing end of the first ratio-check area is subtracted from the content of the numerator memory 19. Thus, the ratio-check area is shifted or moved by one row, namely, the second ratio-check area is established. Step S70 is followed by step S64 to check if the dot ratio of the second ratio-check area is equal to or smaller than the reference dot ratio. In the same manner, steps S62, S64, S66, S68 and S70 are repeated until the dot ratio of the last ratio-check area (consisting of the last 72 rows) has been calculated and compared with the reference dot ratio stored in the memory 17. Thus, the entire dot-matrix pattern data stored in the print buffer 22 is checked for excessive dot ratio in any ratio-check area.

In the event that the dot ratio of a given ratio-check area is found in step S64 to be larger than the reference dot ratio, step S64 is followed by step S72 in which the line of characters represented by the dot-matrix pattern data stored in the print buffer 22 are printed in two movements of the print head 35 along the print line. On the other hand, if there exists no ratio-check area having a dot ratio exceeding the reference dot ratio, step S66 following step S64 is followed by step S74 in which the line of characters are printed in a single movement of the print head 35 along the print line.

It will be understood from the foregoing description when considered in connection with FIGS. 1 and 3: that the CPU 10 and a part of the program memory 18 storing a program for executing step S58 constitute means for setting up the ratio-check area; that the numerator memory 19 serves as memory means for storing the number of dots which are to be formed in the ratio-check area; the CPU 10, the denominator memory 15, and a part of the program memory 18 storing a program for executing step S62, constitute calculating means for calculating the dot ratio of the ratio-check area; that the CPU 10, the reference-dot-ratio memory 17, and a part of the program memory 18 storing a program for executing step S64, constitute judging means for checking whether the dot ratio has exceeded the reference dot ratio; that the CPU 10, and a part of the program memory 18 storing a program for executing step S68, constitute adding means for adding to the content of the memory means (numerator memory 19) the number of dots to be formed in the row preceding the previous ratio-check area; that the CPU 10 and a part of the program memory 18 storing a program for executing step S70, constitute subtracting means for subtracting from the content of the memory means the number of dots to be formed in the row at the trailing end of the previous ratio-check ara; that the CPU 10, the dot-matrix pattern memory 16, and a part of the program memory 18 storing a program for executing step S72, constitute printing control means for printing the characters in the print line in plural movements of the print head 35 along the print line, if the judging means has judged that the dot ratio of the ratio-check area has exceeded the reference dot ratio. The adding means and the subtracting means constitute area-shifting means for moving the ratio-check area along the entire length of the print line.

Figure 4:
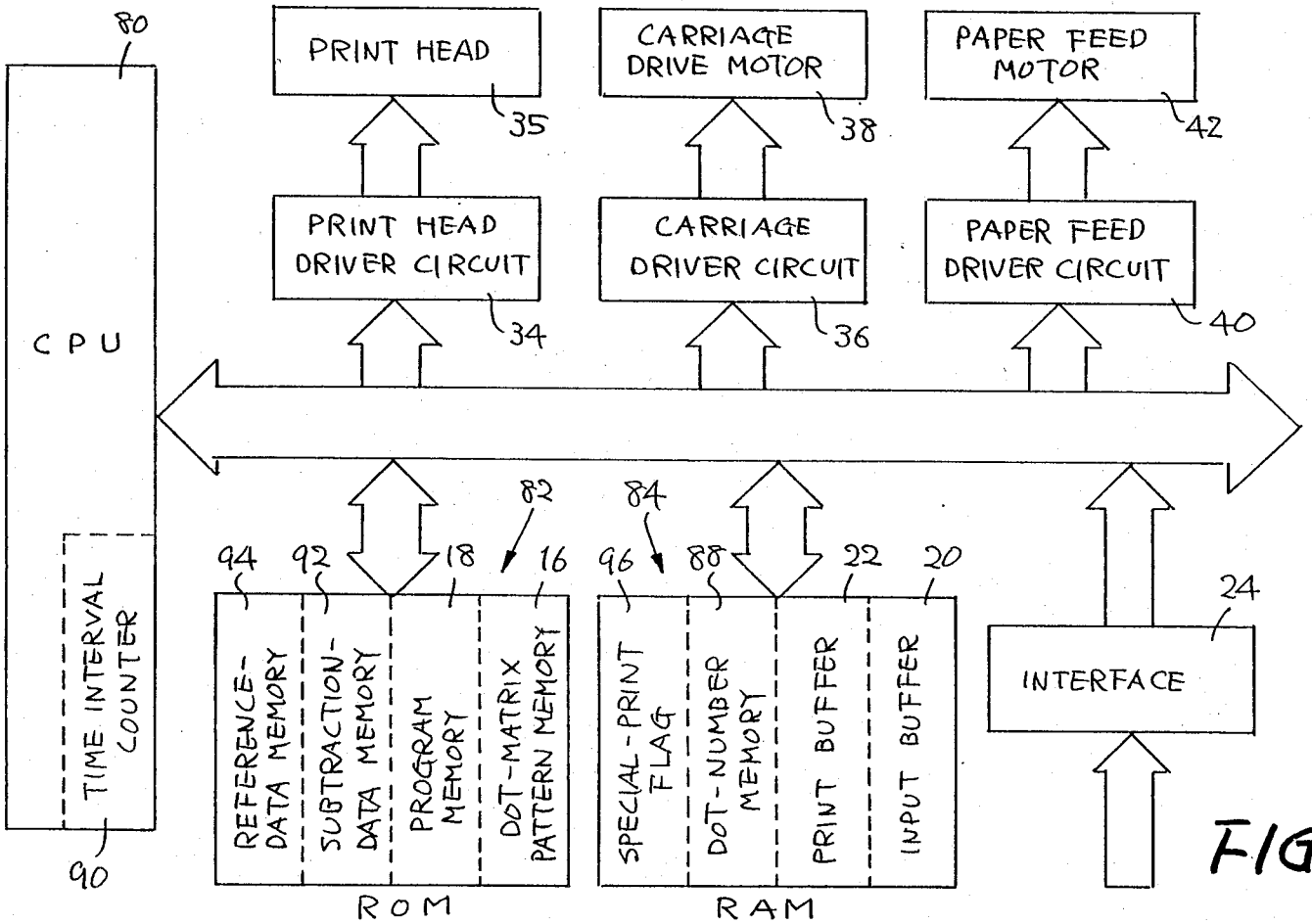
FIG. 4 is a schematic block diagram showing a control system of a dot-matrix printer according to another aspect of the invention.
Figure 5:
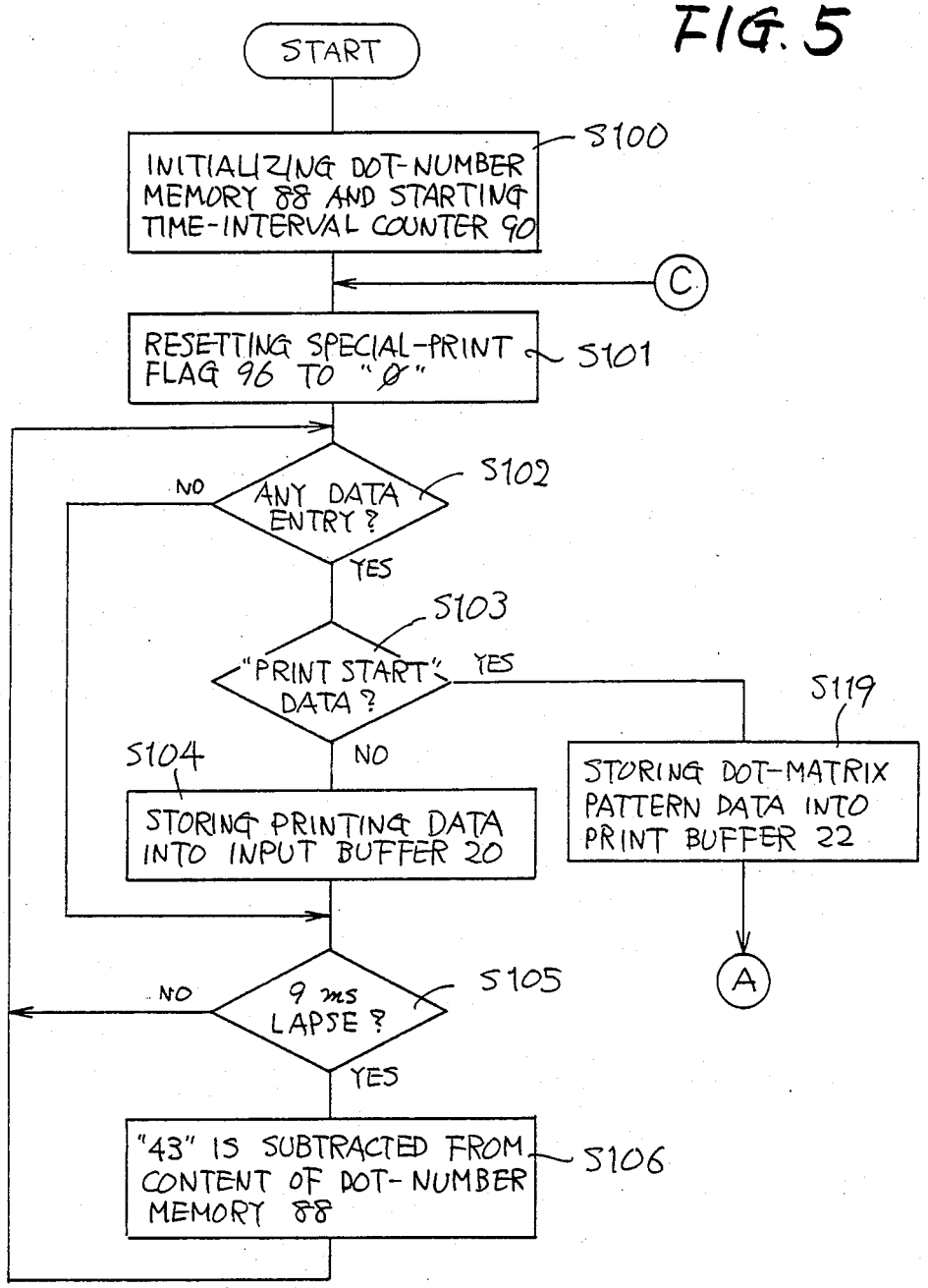
FIGS. 5 and 6 are flow charts showing the operation of the dot-matrix printer of FIG. 4.
Figure 6:
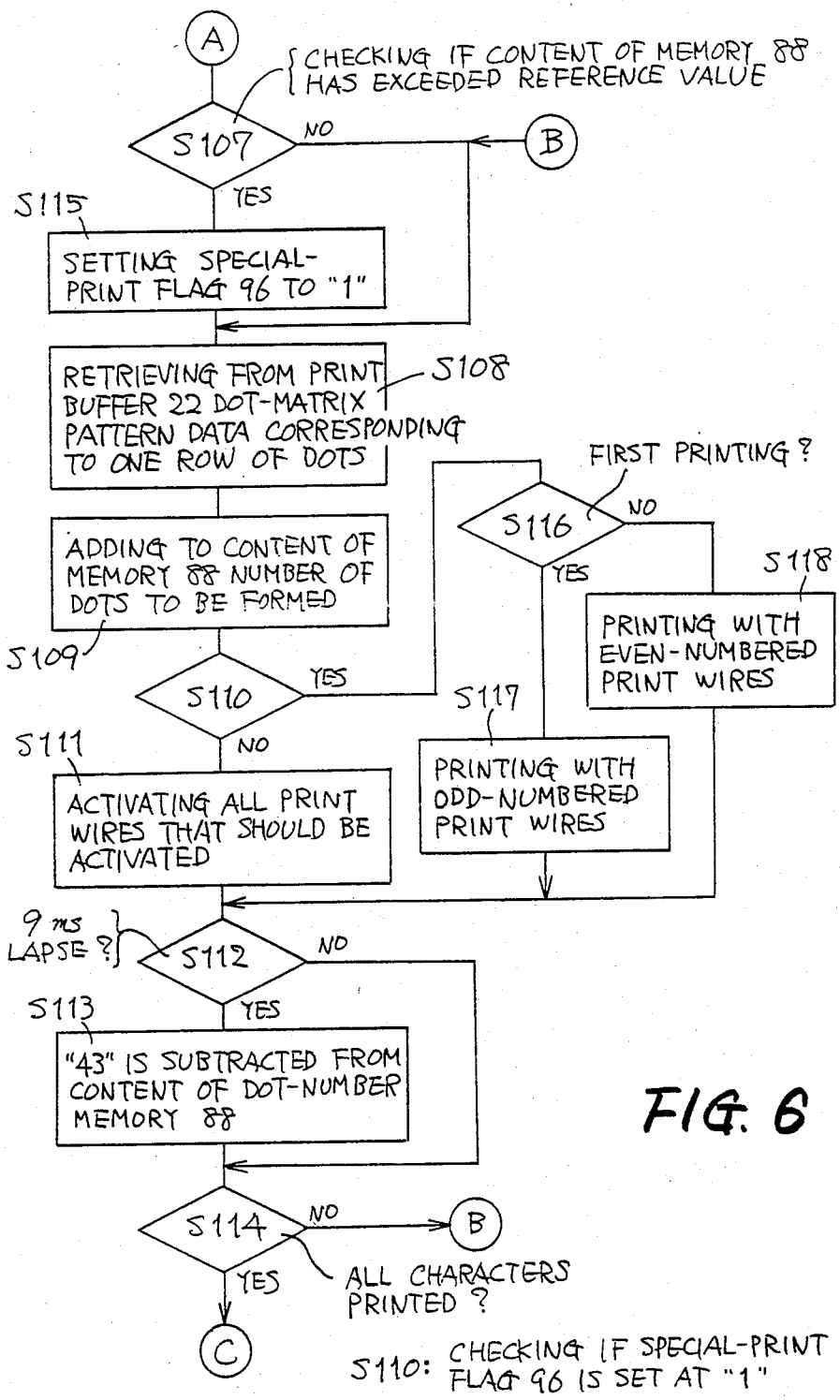

Referring to FIGS. 4–6, another embodiment of the invention will be described.

As in the preceding embodiment, this embodiment of the dot-matrix printer has the print head 35, carriage drive motor 38 and paper feed drive motor 42, which are operated under the control of the respective driver circuits 34, 36 and 40. However, the print head 35 is designed to print characters in a 24×24 dot-matrix pattern. The instant dot-matrix printer has a CPU 80, a ROM 82 and a RAM 84, which have provisions for protecting the print head 35 from a trouble of overheat. The RAM 84 has a dot-number memory 88 which stores a sum of the numbers of dots which are formed by the print head 35, as described later in detail. Upon starting a printing cycle, the dot-number memory 88 is set at a predetermined initial value.

The CPU 80 further has a time-interval counter 90 which measures a time lapse from the start of a printing cycle. Each time the time-interval counter 90 has measured a predetermined time interval, a predetermined value is subtracted from the current content of the dot-number memory 88. In the present embodiment, the above predetermined time interval is selected to be 9 msecs. The predetermined value to be subtracted at the time intervals of 9 msecs. is stored in a subtraction-data memory 92 of the ROM 12. In the present embodiment, this subtraction value is determined to be "43", which is the maximum number of dots which can be formed continuously in the time interval of 9 msecs., with an amount of heat generated in the print head 35 being substantially equal to an amount of heat dissipated from the print head, namely, without any printing failure or inconveniences due to an abnormal rise in the temperature of the print head 35.

It will be understood that the total number of dots counted by the dot-number memory 88 represents a total amount of heat which is supposed to be generated by the print head 35 during a printing operation, and that the "43" dots, i.e., the predetermined number of dots to be subtracted from the content of the dot-number memory 88 at the predetermined time intervals of 9 msecs. represents an amount of heat which is supposed to be dissipated from the print head 35 for every 9 msecs. Accordingly, it will be understood that the current content of the dot-number memory 88 represents an amount of heat currently accumulated in the print head 35, i.e., current temperature of the print head 35.

To check the print head 35 for overheating, the current content of the dot-number memory 88 is compared with a predetermined reference value stored in a reference-data memory 94 of the ROM 12. This reference value is equivalent to a permissible upper limit of the temperature of the print head 35, beyond which the print head 35 can not perform a correct printing operation. In this specific embodiment, the reference value is set at "820,000".

The RAM 84 further has a special-print flag 96 which is set to "1" when the current content of the dot-number memory 88 has exceeded the predetermined reference value of "820,000" (dots) stored in the reference-data memory 94. If the special-print flag 96 is set to "1", the print head driver circuit 34 and the carriage driver circuit 36 are controlled so that a line of characters in question is printed in a special printing mode, that is, the characters in that line are printed in plural movements of the print head 35, as previously described in connection with the preceding embodiment.

Referring now to FIGS. 5 and 6, the operation of the dot-matrix printer of FIG. 4 will be described in greater detail. For easy understanding, steps of operation are indicated by step numbers following letter S.

Upon starting a printing cycle, the CPU 80 executes an initial step S100 to set the dot-number memory 88 at the predetermined value, and start the time-interval counter 86. Step S100 is followed by step S101 in which the special-print flag 96 is reset to "0". Then, the CPU 80 goes to step S102 to check if any data has been received from the external device. If any data has been received, step S102 is followed by step S103 wherein the CPU 80 checks if the received data is "print start" data which is provided at the end of a set of printing data representing each line of characters. If the received data is not the "print start" data, in other words, if the data transferred from the external device is printing data representing a character to be printed, the CPU 80 goes to step S104 to store the printing data into the input buffer 20. Then, the CPU 80 executes step S105 to check if the predetermined time interval of 9 msecs. has lapsed. If not, the CPU 80 goes back to step S102. On the other hand, if the predetermined time interval has passed, step S105 is followed by step S106 wherein the predetermined value "43" is subtracted from the initial content of the dot-number memory 88 (the initial value of which has been set in step S100). Then, the CPU 80 goes back to step S102. In the case where the checking in step S102 reveals that no data has been received, step S102 is directly followed by step S105 to check for the lapse of 9 msecs. If no data has been received for a long time and the content of the dot-number memory 88 is zeroed, the content is held at zero. Namely, the content of the memory 88 will not be a negative value. With the above steps S102 through S106 repeated, a set of printing data representing a line of characters is stored into the input buffer 20. In the meantime, the predetermined value "43" is subtracted from the current content of the dot-number memory 88 at the predetermined time intervals of 9 msecs.

When the "print start" data has been transferred from the external device, the result of checking in step S103 becomes affirmative, and the CPU 80 goes to step S119 to retrieve from the dot-matrix pattern memory 16 dot-matrix pattern data corresponding to the printing data stored in the input buffer 20, and store the retrieved dot-matrix pattern data into the print buffer 22. Successively, the CPU 80 goes to step S107 to check if the current content of the dot-number memory 88 has exceeded the reference value, i.e., "820,000" stored in the reference-data memory 94. If the current content of the dot-number memory 88 has not exceeded the reference value, step S107 is followed by step S108 wherein the CPU 80 retrieves from the print buffer 22 the dot-matrix pattern data corresponding to the first vertical row of dots of a dot-matrix pattern of the first character to be printed. Step S108 is followed by step S109 to add to the current content of the dot-number memory 88 the number of dots which are formed according to the dot-matrix pattern data which has been retrieved from the print buffer 22 in step S108. Subsequently, the CPU 80 executes step S110 to check if the special-print flag 96 has been set at "1" or not. Since the judgement in step S107 is negative and the special-print flag 96 has not been set at "1", step S110 is followed by step S111 wherein the print head driver circuit 34 is controlled so as to activate all the print wires that should be pushed against the recording medium to form dots at the intended positions in the first row of the appropriate dot-matrix pattern. Namely, the printing of the first row is effected in a normal print mode. Step S111 is followed by step S112 to check if the predetermined time interval of 9 msecs has passed or not. If the time interval of 9 msecs. has lapsed, the CPU 80 executes step S113 to subtract the predetermined value "43" from the current content of the dot-number memory 88. Step S113 is then followed by step S114 to check if all of the characters represented by the dot-matrix pattern data in the print buffer 22 have been printed. If the result of checking in step S112 is negative, step S112 is directly followed by step S114. Since only the first row of the first character has been printed at this point of time, the result of checking in S114 is negative, whereby the CPU 80 goes back to step S108 to form the second row of dots of the first character. Thus, the above steps S108 through S114 are repeated until all characters in the line have been printed.

As is apparent from the flow chart of FIG. 6, the numbers of dots to be formed in the individual rows of dots of the characters are added to the current content of the dot-number memory 88 while the printing of the line of characters is in progress. In the meantime, the predetermined value of "43" is subtracted from the current content of the dot-number memory 88 at the time interval of 9 msecs.

As described above, the current temperature of the print head 35 is estimated during the printing of the line of characters. However, even if the content of the dot-number memory 88 has exceeded during a printing cycle, the printing is continued in the normal printing mode until all characters in the line have been printed.

Upon completion of the printing of all characters in the print line in question, the judgement in step S114 becomes affirmative, and the CPU 80 goes back to step S101 to start the printing of the next line of characters.

In the event that the CPU 80 has judged in step S107 that the current content of the dot-number memory 88 exceeded the reference value of "820,000", the special-print flag 96 is set to "1" in step S115. Then, the CPU 80 goes to steps S108, S109 and S110. In this instance, the judgement in step S110 becomes affirmative, whereby step S110 is followed by step S116 to check if the appropriate row of dots is printed for the first time or not. If the judgement is affirmative, step S116 is followed by step S117 wherein the print head driver circuit 34 is controlled so as to activate only the odd-numbered print wires that should be activated according to the appropriate dot-matrix pattern data. Then, the CPU 80 goes to steps S112–S114 and to step S108. With the steps S108–S110, S116–S117 and S112–S114 executed repeatedly, all rows of dots of the entire print line are printed by activating the odd-numbered print wires according to the dot-matrix pattern data retrieved from the print buffer 22, while the print head 35 is moved moved along the print line.

When the first printing with the odd-numbred print wires has been completed, the judgement in step S116 becomes negative, and the CPU 80 goes to step S118 to effect a second printing with only the even-numbered print wires according to the dot-matrix pattern data retrieved from the print buffer 22. By repeating the steps S108–S110, S116, S118, and S112–S114, all rows of dots of the entire print line are printed with only the even-numbered print wires according to the dot-matrix pattern data, while the print head 35 is moved along the print line in the direction opposite to the direction of the first printing. Thus, the second printing is completed. As a result, the judgement in step S114 becomes affirmative, and the CPU 80 goes back to step S101.

As described hitherto, if the current content of the dot-number memory 88 has exceeded the reference value of "820,000" stored in the reference-data memory 94 (step S107) and the special-print flag 96 is set to "1" in step S115, the printing of characters in the line is effected in the special printing mode wherein the characters are printed in two movements of the print head 35 along the line of printing. In the first movement, only the odd-numbered print wires that should be activated are operated according to the dot-matrix pattern data. In the second movement, only the even-numbered print wires are operated to complete the printing of the appropriate line of characters. This special printing mode permits comparatively effective cooling of the print head 35, and contributes to preventing operating failures of the print wires due to overheat of the print head 35, thereby assuring reliable printing and higher print quality of characters including graphical representations of a high dot density.

It will be understood from the foregoing description and FIGS. 4–6: that the CPU 80, and a part of the program memory 18 storing a program for executing step S109 constitute adding means for adding to the current content of the dot-number memory 88 the dot numbers of dots which are formed by the print wires during movements of the print head 35; that the time-interval counter 90 constitute time-measuring means for measuring a time lapse; that the CPU 80, the subtraction-data memory 92, and a part of the program memory 18 storing a program for executing steps S106 and S133, constitute subtracting means for subtracting the predetermined value of "43" from the current content of the dot-number memory 88, each time the time-measuring means has measured the predetermined time interval of 9 msecs.; that the CPU 80, the dot-number memory 88, the reference-data memory 94, and a part of the program memory 18 storing a program for executing step S107, constitute judging means for checking whether the current content of the dot-number memory 88 has exceeded the predetermined reference value of "820,000"; and that the CPU 80, and a part of the program memory 18 storing a program for executing steps S110, S116–S118 and S114, constitute printing control means for controlling the print head driver circuit 34 and the carriage driver circuit 36 so as to cool the print head 35, if the judging means has judged that the current content of the dot-number memory 88 has exceeded the reference value "820,000".

Figure 7:
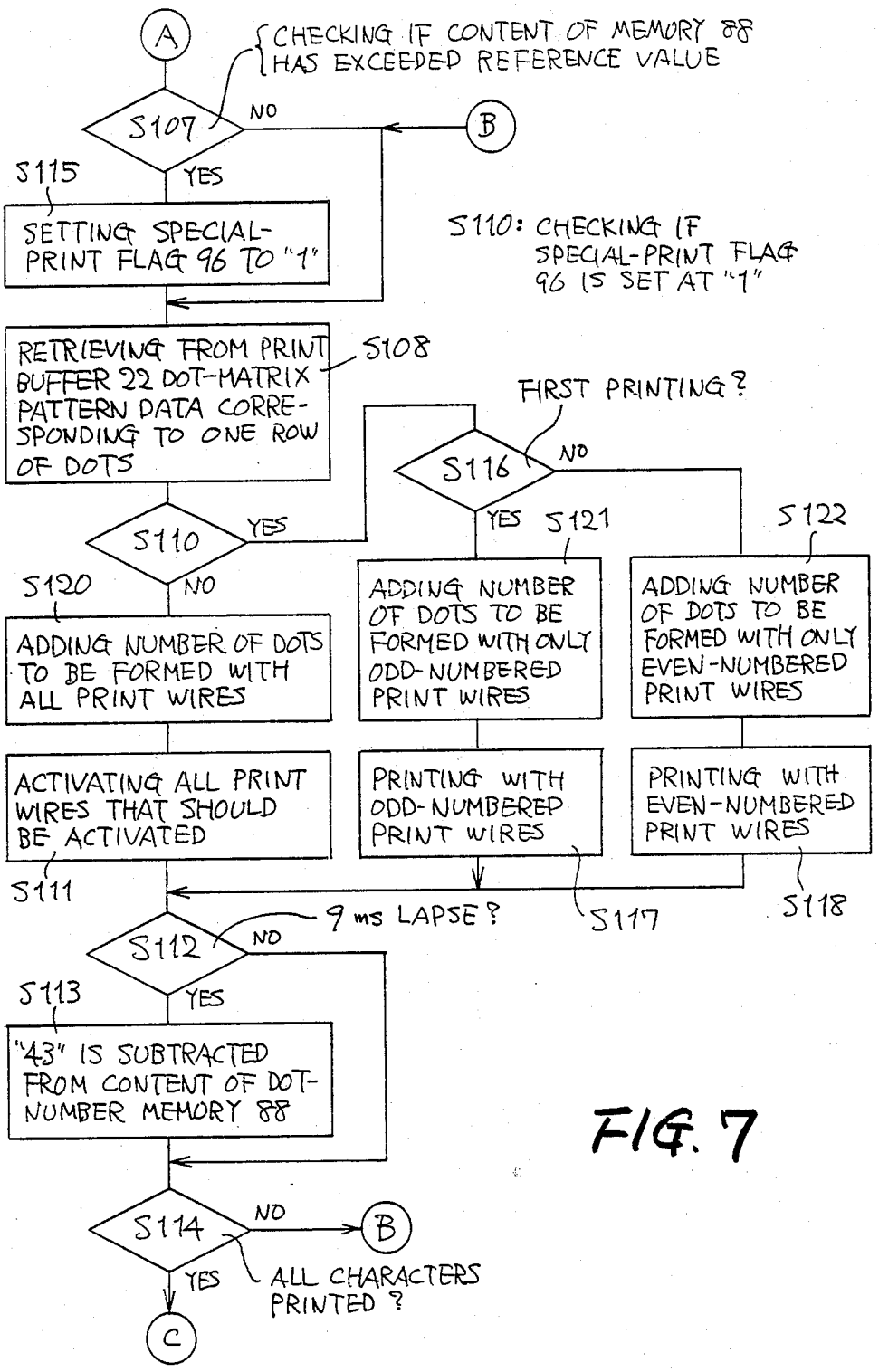
FIGS. 7 and 8 are flow charts showing modified arrangements for controlling the printer of FIG. 4.

While the above embodiment is adapted to add to the current content of the dot-number memory 88 the number of dots to be formed in each row of dots before each of the first and second printings is effected in the special printing mode, it is possible to modify the above embodiment as shown in FIG. 7, wherein the number of dots to be formed with only the odd-numbered print wires is added in step S121 just before the first printing is effected (S117), while the number of dots to be formed with only the even-numbered print wires is added in step S122 just before the second printing is effected (S118). In this arrangement, the number of dots to be formed with all print wires is added in step S120 before the normal printing is effected (S111).

Figure 8:
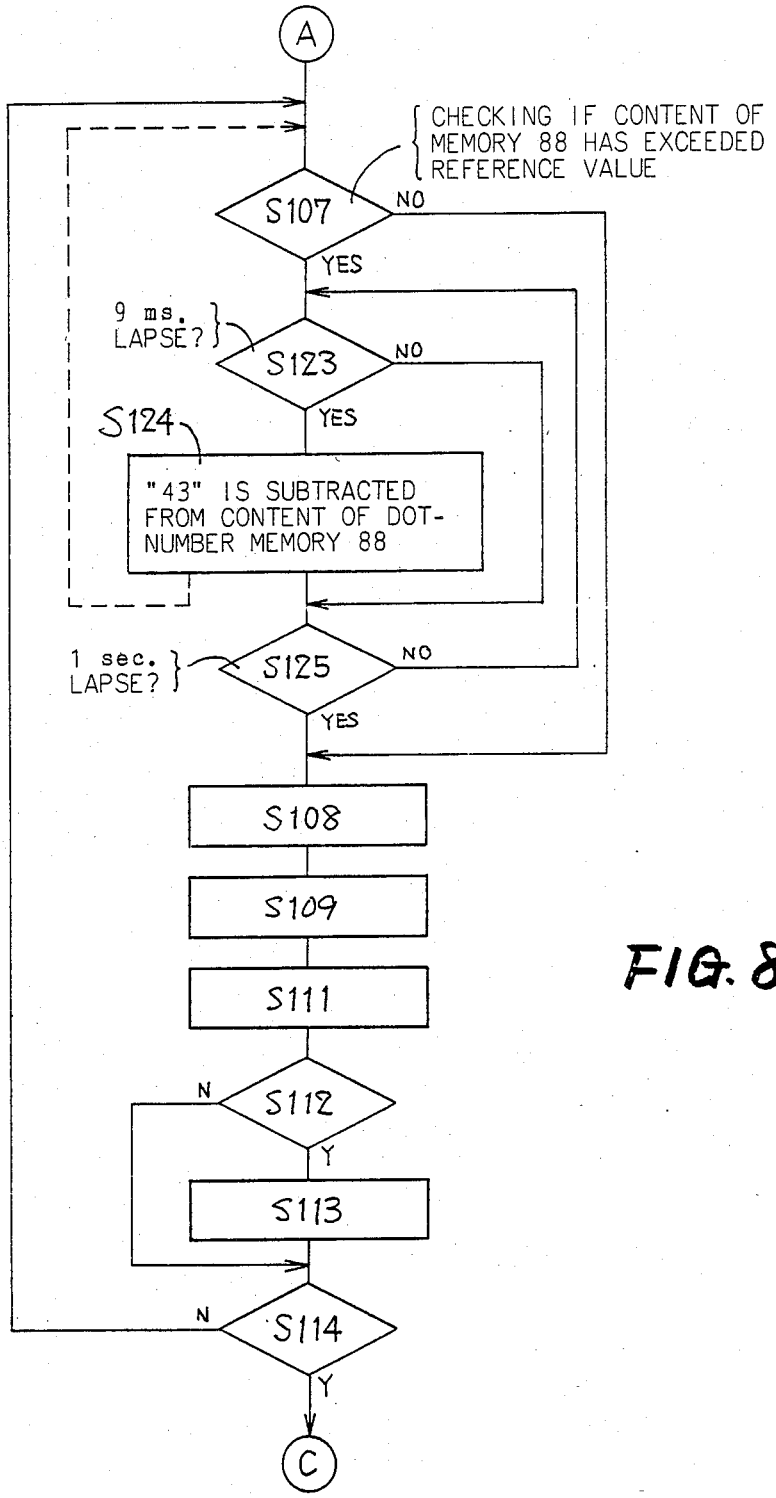

In the embodiments of FIGS. 5–6 and FIG. 7, the printing of all characters in a line is effected in the special printing mode only when the special-print flag has been set to "1" (in step S115) before the printing of that line is initiated in step S108. Namely, even if the current content of the dot-number memory 88 has exceeded the reference value while the printing of a line is in progress, the printing is continued in the normal printing mode. However, it is possible to interrupt the printing operation in the normal printing mode when the current content of the dot-number memory 88 has exceeded the reference value, as illustrated in FIG. 8. In this modified embodiment, step S115 of FIG. 6 is replaced by steps S123–S125, and step S110 of FIG. 6 is not executed. More specifically stated, when the checking in step S107 reveals that the current content of the dot-number memory 88 has exceeded the reference value of "820,000" during the normal mode of printing, the CPU 80 goes to step S123 to check if the predetermined time interval of 9 msecs has lapsed. If this time interval has lapsed, the CPU 80 goes to step S124 to subtract "43" from the content of the dot-number memory 88, and goes to step S125 to check if one second has passed. If the result of checking in step S123 is negative, step S123 is followed by step S125, and these steps S123 and S125 are repeated executed until the predetermined time interval of 9 msecs. has passed. With the steps S123–S125 executed repeatedly, "43" is subtracted from the dot-number memory 88 for each time interval of 9 msecs., until one second has passed. In other words, the printing cycle is interrupted for one second to cool the print head 35. During this interruption of one second, a value of about "4800" is subtracted from the content of the dot-number memory 88. Step S124 is followed by step S108 to resume the normal printing operation. If desired, it is possible to move the print head 35 along the print line during the one-second interruption of the printing cycle, to positively air-cool the print head. In this case, the print head 35 is returned to the position at which the printing was interrupted, so that the printing may be resumed at the interrupted position. It is also possible to eliminate step S125, and make provisions for step S124 to be followed by step S107 as indicated in broken line in FIG. 8. In this case, when the time interval of 9 msecs. has lapsed, "43" is subtracted from the memory 88, in step S124. Then, the CPU 80 returns to step S107. At this time, the checking in step S107 reveals that the content of the dot-number memory 88 has not exceeded the reference value, because of the subtraction in step S124, whereby step S107 is followed by step S08 to resume the normal printing operation. When the content of the dot-number memory 88 has again exceeded the reference value during the printing operation, steps S123 and S124 are again executed and the CPU 80 returns to step S107. Thus, the printing is interrupted 9 msecs each time the content of the dot-number memory 88 has exceeded the reference value. Accordingly, the printing speed is slightly reduced.

In the embodiments of FIGS. 5–6 and FIG. 7, the printing in the special mode consists of the first printing with the odd-numbered print wires, and the second printing with the even-numbered print wires. However, it is possible that the special printing may be accomplished with three or more printing actions in three or more movements of the print head 35 along the print line.

Further, it is possible to modify the embodiment of FIG. 7 such that steps S116, S121, S117, S122 and S118 are replaced by steps S123–S125 of FIG. 8.

While the invention has been described in its preferred embodiments in the form of an impact wire-dot printer, it is to be understood that the invention may be embodied as a thermal-matrix printer or other printers with a print head having plural print elements which are disposed in a row or rows intersecting to a line of printing.

It will be obvious to those skilled in the art that other changes, modifications and improvements may be made in the invention in the light of the foregoing teaching, and without departing from the spirit and scope of the invention defined in the appended claims.

What is claimed is:

1. A dot-matrix printer including a print head having a plurality of print elements which are selectively activated, during a movement of the print head, to form a dot or dots in a vertical row of a dot-matrix pattern representing a character, comprising:

means for setting up a ratio-check area consisting of a first predetermined number of vertical rows of dots in a print line;

memory means for storing the number of dots which are to be formed in said ratio-check area;

calculating means for calculating a dot ratio which is a ratio of the number of dots which is stored in said memory means, with respect to a maximum number of dots which are formable in said ratio-check area;

area shifting means for moving said ratio-check area from a beginning of said print line to an end thereof, by a second predetermined number of rows at one time, said second predetermined number being smaller than said first predetermined number;

judging means for checking whether said dot ratio calculated by said calculating means has exceeded a predetermined reference value, while said ratio-check area is moved; and printing control means for printing the characters in said print line in plural movements of said print head along the print line, if said judging means has judged that said print line includes the ratio-check area the dot ratio of which has exceeded said predetermined reference value.

2. A dot-matrix printer of claim 1, wherein said area-shifting means moves said ratio-check area by a single row of dots at one time.

3. A dot-matrix printer of claim 1, wherein said area-shifting means comprises: adding means for adding to a current content of said memory means the number of dots to be formed in said second predetermined number of rows proceeding said ratio-check area in a direction of movement of the ratio-check area; and subtracting means for subtracting from the current content of said memory means the number of dots to be formed in said second predetermined number of rows at the trailing end of said ratio-check area in said direction.

4. A dot-matrix printer including a print head having plural print elements which are selectively activated, during a movement of the print head, to form a dot or dots in a vertical row of a dot matrix pattern representing a character, comprising:

a dot-number memory;

adding means for adding to a current content of said dot-number memory means, numbers of dots which are formed by said print elements during movements of said print head;

time-measuring means for measuring a time lapse;

subtracting means for subtracting a predetermined value from the current content of said dot-number memory, each time said time-measuring means has measured a predetermined time interval which is shorter than a time necessary to print a line of characters;

judging means for checking whether the current content of said dot-number memory has exceeded a predetermined reference value; and printing control means for controlling said print head so as to cool the print head, if said judging means has judged that the current content of said dot-number memory has exceeded said predetermined reference value.

5. A dot-matrix printer of claim 4, wherein said judging means checks the current content of said dot-number memory after a line of characters have been printed, and before the following line of characters have been printed.

6. A dot-matrix printer of claim 5, wherein said printing control means controls the print head to print the line of characters in plural movements of said print head along the print line, to allow the print head to be cooled.

7. A dot-matrix printer of claim 6, wherein the number of said plural movements is two.

8. A dot-matrix printer of claim 4, wherein said printing control means interrupts a printing operation of said print head to allow the print head to be cooled.

9. A dot-matrix printer of claim 8, wherein said printing control means moves said print head along a line of printing.

10. A dot-matrix printer of claim 4, wherein said judging means checks the current content of said dot-number memory each time a row of dots have been formed.

* * * * *